US011559825B2

(12) United States Patent
Peyrade et al.

(10) Patent No.: US 11,559,825 B2
(45) Date of Patent: Jan. 24, 2023

(54) GRAVITATIONAL METHOD FOR ASSEMBLING PARTICLES

(71) Applicants: CENTRE NATIONAL DE LA RECHERCHE SCIENTIFIQUE, Paris (FR); UNIVERSITE GRENOBLE ALPES, Saint Martin d'Heres (FR); SMART FORCE TECHNOLOGIES, Grenoble (FR)

(72) Inventors: David Peyrade, Moirans (FR); Anthony Leonard, Grenoble (FR); Julien Cordeiro, Grenoble (FR); Olivier Lecarme, Grenoble (FR)

(73) Assignees: CENTRE NATIONAL DE LA RECHERCHE SCIENTIFIQUE, Paris (FR); UNIVERSITE GRENOBLE ALPES, Saint Martin d'Heres (FR); SMART FORCE TECHNOLOGIES, Grenoble (FR)

( * ) Notice: Subject to any disclaimer, the term of this patent is extended or adjusted under 35 U.S.C. 154(b) by 44 days.

(21) Appl. No.: 16/753,637

(22) PCT Filed: Oct. 5, 2018

(86) PCT No.: PCT/EP2018/077113
§ 371 (c)(1),
(2) Date: Apr. 3, 2020

(87) PCT Pub. No.: WO2019/068857
PCT Pub. Date: Nov. 4, 2019

(65) Prior Publication Data

US 2020/0269274 A1 Aug. 27, 2020

(30) Foreign Application Priority Data

Oct. 5, 2017 (FR) ..... 1759352

(51) Int. Cl.
*B05D 1/18* (2006.01)
*B05D 1/00* (2006.01)

(52) U.S. Cl.
CPC ..... *B05D 1/18* (2013.01); *B05D 1/00* (2013.01)

(58) Field of Classification Search
CPC ..... B05D 1/00
See application file for complete search history.

(56) References Cited

U.S. PATENT DOCUMENTS 6,991,847 B2 * 1/2006 Padmanabhan ..... B82Y 20/00 428/316.6
7,794,538 B2 * 9/2010 Marshall ..... B82Y 20/00 117/4

(Continued)

FOREIGN PATENT DOCUMENTS

WO 2017018946 2/2017
WO WO2017018946 * 2/2017

OTHER PUBLICATIONS

Blaaderen et al., "Template-directed colloidal crystallization" (1997) (Year: 1997).*

(Continued)

*Primary Examiner* — Nathan T Leong
(74) *Attorney, Agent, or Firm* — Greer, Burns & Crain, Ltd

(57) ABSTRACT

A method for assembling particles on a microstructured surface of a sample. The method includes a step of covering the surface of the sample with a colloidal suspension with a so-called covering temperature range. The method includes a step of sedimentation of particles contained in the colloidal suspension such that particles settle towards the surface of the sample, the sedimentation step being carried out within a so-called sedimentation temperature range.

20 Claims, 3 Drawing Sheets

(56) References Cited

U.S. PATENT DOCUMENTS

| | | | | |
|---|---|---|---|---|
| 2002/0015792 | A1 | 2/2002 | Nagayama et al. | |
| 2002/0045030 | A1* | 4/2002 | Ozin | B82Y 40/00 428/173 |
| 2011/0315052 | A1 | 12/2011 | Zettsu et al. | |
| 2012/0070911 | A1* | 3/2012 | Peyrade | G01N 35/00029 436/501 |
| 2012/0171448 | A1 | 7/2012 | Akey et al. | |
| 2015/0321216 | A1 | 11/2015 | Picard et al. | |
| 2016/0136682 | A1 | 5/2016 | Mai et al. | |

OTHER PUBLICATIONS

French Search Report and Written Opinion from the corresponding French Patent Application No. 1759352, dated Jun. 6, 2018.

International Search Report and Written Opinion from the corresponding International Patent Application No. PCT/EP2018/077113, dated Jan. 14, 2019.

Asbahi, M., et al., "Directed self-assembly of sub-10nm particle clusters using topographical templates," Nanotechnology 27, 2016, 6 pages.

De Gennes, P., et al., "The world of drops, bubbles, pearls and waves," ISBN : 978-2-7011-4055-1, Belin, 2005, English Summary, 2 pages.

Iler, R.K., "Multilayers of Colloidal particles," J. Colloid Interface Sci. 21, 1966, pp. 569-594.

Lin, B., et al., "Langmuir monolayers of gold nanoparticles," Thin Solid Films 515, 2007, pp. 5669-5673.

Wikipedia, "Marangoni effect" Overview Description, retrieved from https://en.wikipedia.org/w/index.php?title=Marangoni_effect&oldid=1081597159 on Apr. 21, 2022, 5 pages.

Wikipedia, "Self-assembly" Overview Description, retrieved from https://en.wikipedia.org/w/index.php?title=Self-assembly&oldid=1073770578 on Apr. 21, 2022, 13 pages.

* cited by examiner

GRAVITATIONAL METHOD FOR ASSEMBLING PARTICLES

BACKGROUND

The present invention relates to the field of assembling particles on a surface of a sample.

The present invention relates in particular to assembling particles contained in a colloidal suspension on the surface of a microstructured substrate.

Techniques are known in the state of the prior art for assembling particles on the microstructured surface of a sample by evaporation of a colloidal suspension which is in contact with said microstructured surface of the sample and in which particles are contained. Evaporation can be controlled, by controlling the temperature and the hygrometry, or natural.

Techniques are also known in the state of the prior art for assembling particles on a microstructured surface of a sample by controlled withdrawal of the sample from the colloidal suspension containing the particles and in which the sample is immersed.

These techniques require the velocity of removal of the colloidal suspension, or the speed of evaporation of the colloidal suspension, or the velocity of withdrawal of the sample and the angle formed by the sample with the surface of the colloidal suspension, to be accurately controlled.

These techniques, as well as variants thereof, are based on the joint actions of the Marangoni effect and the capillary forces acting on the particles contained in the colloidal suspension. The "Marangoni effect" describes the phenomenon of overconcentration of particles in the colloidal suspension in proximity to the triple sample/colloidal suspension/air interface. During the movement of the colloidal suspension with respect to the sample, the capillary forces trap the particles in the microstructures.

The physical phenomena which govern the implementation of the methods proposed in the state of the art overall, impose significantly low assembly speeds. The highest assembly speeds of the methods of the state of the art are of the order of one square millimetre per minute. These low assembly speeds constitute a technological barrier obstructing the transfer of the particle assembly technology to an industrial scale. In addition, these low assembly speeds require extremely long assembly times, which are proportional to the size of the surface area of the microstructured sample.

A purpose of the invention is in particular to propose a method:

- the assembly speed of which does not depend on the surface area of the microstructured sample, and/or
- the assembly speed of which is quick and compatible with industrial constraints, i.e. having a total implementation duration, for an assembly of $10^6$ particles on a sample surface area greater than 1 $cm^2$, less than thirty minutes, and/or
- making it possible to carry out an assembly of one particle per microstructure.

SUMMARY

To this end, according to a first aspect of the invention, a method for assembling particles on a microstructured surface of a sample is proposed, said method comprising:

- a step of covering the surface of the sample with a colloidal suspension, the covering step being carried out within a temperature range called covering temperature range, then
- a step of sedimentation of particles contained in the colloidal suspension so that particles sediment in the direction of the surface of the sample, the sedimentation step being carried out within a temperature range called sedimentation temperature range.

The method according to the invention can comprise a condensation step implemented:

- subsequently to the covering step, and
- prior to and/or concomitantly with the sedimentation step, the condensation step being carried out within a temperature range called condensation temperature range, an upper limit of the condensation temperature range being less than a lower limit of the covering temperature range.

The term "microstructured surface", known to a person skilled in the art, denotes a surface having microstructures arranged according to one or more predetermined patterns.

A microstructure extends at least partially in a direction extending substantially from a face of the sample comprising the microstructured surface towards the inside of the sample.

A microstructure can be arranged in order to receive one or more particles.

A microstructure can preferably be arranged in order to receive a single particle.

A microstructure can have any shape whatsoever.

A major portion of the particles contained in the colloidal suspension can, preferably, be sedimenting particles.

In the present application, the term "a major portion of the particles" can be understood to be a portion greater than 50% of the number of these particles.

In the case of the present application, each microstructure can have a minimum Feret diameter greater than a given threshold value and each particle contained in the colloidal suspension can have a maximum Feret diameter less than this given threshold value, so that the particles can freely enter the microstructures under the effect of gravitation.

The covering step can, preferably, be carried out by laminar flow of the colloidal suspension over the surface of the sample in a direction that is substantially parallel to said surface of the sample.

In the case of the present application, a range can be limited to one single value. In this case, a lower limit of this range is equal to an upper limit of this range which is equal to this single value.

During the sedimentation step, preferably at least a portion of the sedimenting particles enter at least partially into the microstructures.

During the sedimentation step, preferably at least a portion of the sedimenting particles enter completely into the microstructures.

A particle can freely enter into a microstructure as far as a surface forming a base of the microstructure.

A number of particles contained in the colloidal suspension can, preferably, be at least equal to the number of microstructures which the microstructured sample contains.

In the present application, an upper limit, or respectively a lower limit, of a range (for example a temperature range) can be less than or equal to, respectively greater than or equal to, a lower limit, or respectively an upper limit, of an adjacent range (for example temperature, respectively).

Gas bubbles can be trapped in the microstructures during the implementation of the covering step. The gas bubbles are constituted by the gas surrounding the sample during the implementation of the covering step.

The condensation step is arranged to expel gas bubbles contained in all or a portion of the microstructures by:

dissolving the gas bubbles in water, and/or condensing the water contained in gaseous form in the gas bubbles.

The gas surrounding the sample can be ambient air.

The condensation step makes it possible to expel the air bubbles from the microstructures by:

dissolving the bubbles in water, and condensing the aerated water from the air bubbles.

The condensation step can be implemented prior to the sedimentation step and a lower limit of the sedimentation temperature range can be greater than an upper limit of the condensation temperature range.

The condensation step can, preferably, be carried out at a condensation temperature such that an upper limit of the condensation temperature range is less than a lower limit of the sedimentation temperature range by at least 10 degrees Celsius) (°).

The condensation step can be at least partially carried out simultaneously with the sedimentation step.

The entire condensation step can be carried out simultaneously with the sedimentation step.

Only a part of the condensation step can be carried out concomitantly with a part of the sedimentation step.

The method according to the invention can comprise a step of trapping particles in the microstructures of the sample, the trapping step being carried out:

concomitantly with or subsequently to the sedimentation step, and within a temperature range called trapping temperature range.

The trapping step can be at least partially carried out simultaneously with the sedimentation step.

The entire trapping step can be carried out simultaneously with the sedimentation step.

Only a part of the trapping step can be carried out concomitantly with a part of the sedimentation step.

A lower limit of the trapping temperature range can be greater than an upper limit of the covering temperature range.

The trapping step makes it possible to increase a fill rate of the microstructures by the particles by increasing the convection flow of the particles in the colloidal suspension.

The trapping step can, preferably, be carried out at a trapping temperature such that a lower limit of the trapping temperature range is greater than an upper limit of the covering temperature range by at least 10° C.

The trapping step can be implemented subsequently to the sedimentation step and a lower limit of the trapping temperature range can be greater than an upper limit of the sedimentation temperature range.

The trapping step can, preferably, be carried out at a trapping temperature such that a lower limit of the trapping temperature range is greater than an upper limit of the sedimentation temperature range by at least 10° C.

The method according to the invention can comprise a step of removing the colloidal suspension from the microstructured surface of the sample, according to a movement that is substantially tangential with respect to said microstructured surface, so as to remove an excess of particles present on the surface of the sample, the removal step being implemented subsequently to the sedimentation step and/or the trapping step.

The step of removal of the colloidal suspension can preferably be carried out by laminar flow of the colloidal suspension over the surface of the sample.

The covering step can be carried out based on a suspension a dispersing phase of which comprises:

at least partly water.

The covering step can be carried out based on a suspension a dispersing phase of which comprises:

at least partly water, and a surfactant.

The covering step can be carried out based on a suspension the dispersing phase of which comprises a mixture of solvents.

The dispersing phase can contain a quantity of water less than 5% by weight.

In the present application, the term "at least partly water" can be understood to be a quantity of water greater than one part per million (ppm).

According to a first alternative, the sedimentation step can be carried out based on a colloidal suspension under a sedimentation regime, the effects of gravitation on at least a portion of the particles contained in the colloidal suspension being greater than the thermal agitation effects on said at least a portion of the particles contained in the colloidal suspension.

A maximum sedimentation rate of a particle contained in the colloidal suspension can be expressed as being equal to:

$$v_{sed} = \frac{2\Delta\rho g D_{fm}^2}{9\mu}, \quad \text{(equation 2)}$$

with $D_{fm}$: a maximum Feret diameter value of this particle contained in the colloidal suspension, μ: dynamic viscosity of the dispersing phase at the temperature T, Δρ: difference between a mass density of the particles contained in the colloidal suspension and a mass density of the dispersing phase, ρ: mass density of the dispersed phase (of the particles) at the temperature T, g: the gravitational constant.

According to the first alternative, a sedimentation rate of the sedimenting particles is such that a major portion of said sedimenting particles is still contained in the dispersing phase subsequently to the implementation of:

the covering step, or covering and condensation steps.

According to the first alternative, the major portion of the sedimenting particles is still contained in the dispersing phase subsequently to the implementation of the covering step, or the covering and condensation steps, and is, preferably, at least equal to the number of microstructures which the microstructured sample contains.

According to the first alternative, a size distribution of the particles contained in the colloidal suspension can be such that a maximum Feret diameter $D_{fm}$ of each particle contained in the colloidal suspension is such that:

$$D_{fm} \geq 2.5\ 10^{-3}\left(\frac{k_B T \mu^2}{\pi \rho \Delta_\rho^2 g^2}\right)^{\frac{1}{7}}, \quad \text{(equation 1)}$$

with $k_B$: the Boltzmann constant,

T: a temperature of the particles contained in the suspension corresponding to the lower limit of the sedimentation temperature range, μ: dynamic viscosity of the dispersing phase at the temperature T, Δρ: difference between a mass density of the particles contained in the colloidal suspension and a mass density of the dispersing phase, ρ: mass density of the dispersed phase (of the particles) at the temperature T, g: the gravitational constant.

The temperature T of the particles contained in the suspension can be considered to be equal, at all times, to the temperature of the dispersing phase.

According to the first alternative, a size distribution of the particles contained in the colloidal suspension can be such that:

- a maximum Feret diameter $D_{fm}$ of each particle contained in the colloidal suspension is greater than 100 nm, preferably than 150 nm, and/or
- a maximum Feret diameter $D_{fm}$ of each particle contained in the colloidal suspension is less than 100 μm, preferably greater than 50 μm.

According to the first alternative, each microstructure can have a minimum Feret diameter, in a plane parallel to the surface of the sample, being greater than 90 nanometres (nm) and less than 110 micrometres (microns or μm).

According to a second alternative, the sedimentation step can be carried out based on a colloidal suspension in a Brownian ballistic regime, said sedimentation step comprising a step of modifying the composition of the colloidal suspension covering the microstructured surface of the sample, so that, after this modification step, the particles contained in the colloidal suspension sediment.

According to the second alternative, a maximum Feret diameter of each particle contained in the colloidal suspension can be such that:

$$D_{fm} \leq 2.5\ 10^{-3}\left(\frac{k_B T \mu^2}{\pi \rho \Delta_\rho^2 g^2}\right)^{\frac{1}{7}}.$$

According to the second alternative, the step of modifying the composition of the colloidal suspension can be carried out in such a way as to produce a flocculation of at least a portion of the particles contained in the colloidal suspension.

According to the second alternative, the step of modifying the composition of the colloidal suspension can comprise the addition of a flocculation agent in the colloidal suspension.

According to the second alternative, the flocculating agent can be an inorganic salt or a polymer.

According to the second embodiment, an inorganic salt can, among other things, be selected from the family of the metal salts, it can for example be an iron or aluminium salt.

According to the second embodiment, preferably, the flocculating agent can be selected from the polymer flocculants. The polymer flocculant can be selected, for example, from the family of the polyacrylamides.

According to the second embodiment, the flocculation step starts the sedimentation of the particles.

All of the steps that can precede and/or follow and/or be concomitant with the sedimentation step can be combined with the first alternative or the second alternative of the sedimentation step of the method according to the invention.

At least a portion of the steps can be implemented in a microfluidic device comprising, among other things, a chamber arranged to receive the colloidal suspension, and one of the walls of which comprises, at least partially, the microstructured surface of the sample.

The term microfluidic device, well known to a person skilled in the art, defines a device arranged in order to receive a maximum volume of fluid, typically less than $10^{-8}$ litres, and/or having a channel the width and/or height of which is less than one millimetre.

When at least a portion of the steps are implemented in a microfluidic device, the at least a portion of the microstructured surface can be oriented upwards and comprised within a lower wall of the chamber of said microfluidic device so that the particles sediment in the direction of said microstructured surface.

Preferably, all of the steps of the method can be carried out in the microfluidic device.

A distance between the microstructured surface and an upper wall of the chamber of the microfluidic device can be adapted so that an average distance that the sedimenting particles have to travel in order to reach the microstructured surface is less than 3 mm.

The step of covering the surface of the microstructured sample with the colloidal suspension can be carried out by introducing the colloidal suspension into the chamber and by flow by capillary effect of the colloidal suspension into the chamber.

The step of covering the surface of the microstructured sample with the colloidal suspension can be carried out by introducing the colloidal suspension into the chamber and be devoid of the flow of the colloidal suspension into the chamber.

Introducing the colloidal suspension into the chamber can be carried out by injection and/or suction and/or aspiration.

During the step of removing the colloidal suspension, a receding contact angle formed between the colloidal suspension and the microstructured surface of the sample can be comprised between 10° and 80°, preferably between 20 and 70°, more preferably between 30 and 50°.

The covering temperature range can be comprised between 0 and 50° C.

The covering temperature range can, preferably, be comprised between 15 and 30° C.

The lower limit of the condensation temperature range can be less than 20° C., preferably less than 15° C., more preferably less than 10° C.

The sedimentation temperature range can be comprised between 0 and 50° C.

The sedimentation temperature range can, preferably, be comprised between 15 and 30° C.

The covering temperature range can be equal to the sedimentation temperature range.

The lower limit of the trapping temperature range can be greater than 25° C., preferably greater than 30° C., more preferably greater than 40° C.

A linear velocity of removal of the colloidal suspension can be comprised between 0.05 and 50 cm/min.

Preferably, the implementation duration of the condensation step can be less than 10 mins, preferably than 5 mins.

Preferably, the implementation duration of the sedimentation step can be less than 15 mins, preferably 10 than mins.

Preferably, the implementation duration of the trapping step can be less than 20 mins.

BRIEF DESCRIPTION OF THE DRAWINGS

Other advantages and characteristics of the invention will become apparent on reading the detailed description of implementations and embodiments which are in no way limitative, and the following attached drawings.

DETAILED DESCRIPTION

Figure 1:
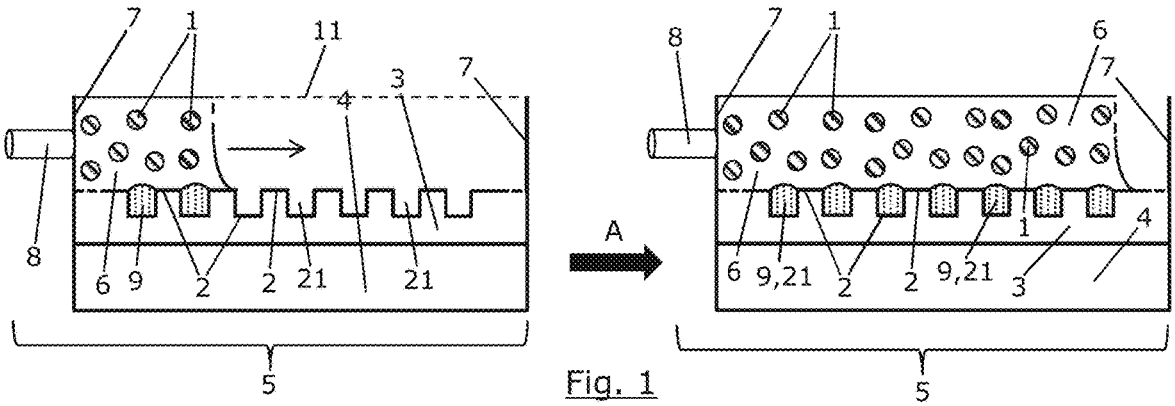
FIGS. 1 to 5 are diagrammatic representations of profile views of a microfluidic device comprising a microstructured surface of a substrate, illustrating steps of the method according to the invention.

As the embodiments described below are in no way limitative, variants of the invention can be considered in particular comprising only a selection of the characteristics described, in isolation from the other characteristics described (even if this selection is isolated within a phrase comprising these other characteristics), if this selection of characteristics is sufficient to confer a technical advantage or to differentiate the invention with respect to the state of the prior art. This selection comprises at least one, preferably functional, characteristic without structural details, or with only a part of the structural details if this part alone is sufficient to confer a technical advantage or to differentiate the invention with respect to the state of the prior art.

With reference to FIGS. 1 to 10, an embodiment is described of the method for assembling particles 1 on a microstructured surface 2 of a sample 3 comprising microstructures 21, also called microcavities. The sample 3 is mounted within a microfluidic device 5 as described in document EP2942111A2. This device 5 comprises, among other things, a temperature controller 4 of the Pelletier type and a microfluidic cell forming a chamber 10 arranged to receive the colloidal suspension 6. The microfluidic cell comprises, among other things, a PDMS (polydimethylsiloxane) base, two side walls 7 of which are shown diagrammatically, an upper wall 11 composed of a glass slide 11 and the microstructured surface 2 of the sample 3.

The sample 3 can be produced from any type of material. A step of physical and/or chemical treatment of the surface 2 of the sample 3 can be carried out prior to the implementation of the method, for example a coating of the surface with a hydrophobic compound such as a fluorinated compound by, among other things, soaking or chemical vapour deposition or spraying of the compound in question on the surface. In the present case, a product marketed by DAIKIN and sold under the brand name of "Optool" was used. A person skilled in the art knows the combination of the product and associated treatment method as "OPTOOL treatment". Where necessary, this treatment will be implemented so that during the removal step E of the colloidal suspension 6, a receding contact angle formed between the colloidal suspension 6 and the microstructured surface 2 of the sample 3 is comprised between 10° and 80°, preferably between 20 and 70°, more preferably between 30 and 50°.

Depending on the embodiment, during the implementation of the covering step A, an advancing contact angle formed between the colloidal suspension 6 and the microstructured surface 2 of the sample 3 is comprised between 70 and 110°.

Depending on the embodiment, the sample 3 is made from PDMS. A wall 7 of the microfluidic device 5 also comprises a capillary 8 arranged so that a needle 13 of a syringe, comprising the colloidal suspension 6 to be injected, is inserted therein. An opposite wall 7 contains a vent 14. The capillary 8 should have an inner diameter less than the outer diameter of the needle 13.

The different variants of cells that can be used during the implementation of the method have a volume comprised between 50 μl and 5 ml and a combined surface area comprised between 100 $mm^2$ and 5 $cm^2$.

The colloidal suspension 6 used during the implementation of the method is under a sedimentation regime, i.e. the effects of gravitation on at least a portion of the particles 1 contained in the colloidal suspension 6 are greater than the thermal agitation effects on said at least a portion of the particles 1 contained in the colloidal suspension 6. Unless otherwise specified, the colloidal suspension 6 used during the implementation of the method is a suspension of particles 1 of polystyrene (PS) with a maximum Feret diameter, or exodiameter, comprised between 9 and 11 μm and the concentration of particles 1 is still such that the number of particles 1 is greater than the number of microstructures 21. The dispersing phase is water in which is diluted at 1/10,000 a surfactant marketed under the name of Triton X-100. Triton X-100 is a solution containing polyoxyethylene ($C_8H_{17}C_6H_4(OC_2H_4)_{9\text{-}10}OH$) at a concentration of 10% by weight. Unless otherwise specified, the total volume of colloidal suspension 6 injected in the chamber 10 is 775 μl and the corresponding concentration of particles 1 is $10^6$ particles 1 per millilitre.

A size distribution of the particles 1 contained in the colloidal suspension 6 is such that a maximum Feret diameter $D_{fm}$ of each particle 1 contained in the colloidal suspension 6 is such that:

$$D_{fm} \geq 2.5\ 10^{-3}\left(\frac{k_B T \mu^2}{\pi \rho \Delta_\rho^2 g^2}\right)^{1/7},$$

with $k_B$: the Boltzmann constant,

T: a temperature of the particles contained in the suspension corresponding to the lower limit of the sedimentation temperature range, μ: dynamic viscosity of the dispersing phase at the temperature T, $\Delta\rho$: difference between a mass density of the particles contained in the colloidal suspension and a mass density of the dispersing phase, $\rho$: mass density of the dispersed phase at the temperature T, g: the gravitational constant.

It is possible to use any type of organic, inorganic or metallic (alloys and oxides) particles 1. For a given type of particles 1 and a given dispersing phase, it will be possible, based on equation 1, to calculate the lower threshold value of the maximum Feret diameter of said particles 1 to be used in order to produce a colloidal suspension 6 under a sedimentation regime. An upper threshold value of the maximum Feret diameter of the particles 1 can be determined based on equation 2 and, in particular, as a function of the geometry of the cell, so that a major portion of the particles 1 of the colloidal suspension 6 are still in suspension following the implementation of the covering A and condensation B steps. At least a portion of the sedimenting particles 1, contained in the colloidal suspension 6, sediment in the direction of the surface 2 of the sample 3. A major portion of the particles 1 contained in the colloidal suspension 6 are sedimenting particles 1.

Based on equation 1, equation 2 and the different types of common materials in which the particles 1 can be produced, an approximate, non-limitative estimate can be made of a size range of particles 1 for which the different types of particles 1, constituted by said different types of materials, are under a sedimentation regime. This size range is such that a size distribution of the particles contained in the colloidal suspension can be such that:

- a maximum Feret diameter $D_{fm}$ of each particle contained in the colloidal suspension is greater than 100 nm, preferably than 150 nm, and/or
- a maximum Feret diameter $D_{fm}$ of each particle contained in the colloidal suspension is less than 100 μm, preferably greater than 50 μm.

By way of a non-limitative example of particles 1 that can be used to implement a colloidal suspension 6 under a sedimentation regime, it is possible to use particles of PS of a size comprised between 3 μm and 50 μm, particles of silicon dioxide ($SiO_2$) of a size comprised between 550 nm and 8 μm or particles of gold of a size comprised between 150 nm and 2.3 μm.

With regard to equation 1, calculation of the lower threshold value of the maximum Feret diameter of the particles 1 of the colloidal suspension 6, the dynamic viscosity value of the dispersing phase can be drawn from tables known to a person skilled in the art. When this value is measured, a capillary viscometer or a rotational or falling sphere viscometer can preferably be used.

Unless otherwise specified, the sample 3 has a density of microstructures 21 of 75000 microstructures 21 per square centimetre. Each microstructure 21 is arranged to receive a single particle 1. Each microstructure 21 has a minimum Feret diameter, or mesodiameter greater than a given threshold value and each particle 1 contained in the colloidal suspension 6 has a maximum Feret value less than this given threshold value, so that the particles 1 can freely enter the microstructures 21 under the effect of gravitation. The microstructures 21 have a minimum Feret diameter, in a plane parallel to the surface 2 of the sample 3, being greater than 90 nanometres (nm) and less than 110 micrometres (microns or μm). The minimum Feret diameter of a microstructure is approximately 11 μm.

Unless otherwise specified, the height of the chamber 10 i.e. the distance between the microstructured surface 2 and the glass slide 11, is 1 mm.

The method according to the invention comprises a covering step A, illustrated in FIG. 1, of the surface 2 of the sample 3 by the colloidal suspension 6; the covering step A is carried out at an ambient temperature comprised between 19 and 23° C. No temperature limit is imposed during the implementation of the covering step A. This covering step A can be carried out within a temperature range comprised between 0 and 50° C., preferably between 10 and 40° C., more preferably between 15 and 30° C.

This covering step A is carried out by introducing the colloidal suspension 6 into the chamber 10 and by laminar flow, by capillary effect, of the colloidal suspension 6 on the surface 2 of the sample 3 according to a movement that is substantially tangential extending in a direction connecting the two walls 7. During the covering step A, air bubbles 9 are trapped inside the microstructures 21 which prevents the particles 1 from entering therein.

According to the embodiment, the bubbles 9 trapped inside the microstructures 21 are air bubbles as the covering step is carried out in ambient air.

Figure 2:
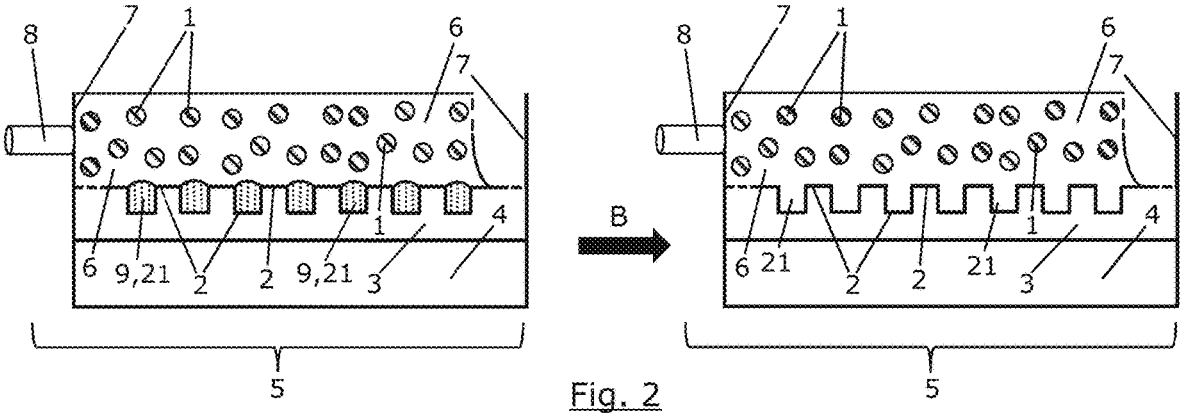

The covering step A is followed by the condensation step B, illustrated in FIG. 2, carried out at a temperature of 5° C. being applied for a duration of 2 min. The purpose of this step is to free the microstructures 21 by expelling the air bubbles from the microstructures 21. The condensation step makes it possible to expel the air bubbles from the microstructures by:

dissolving the bubbles in water, and condensing air bubbles from the aerated water.

Figure 3:
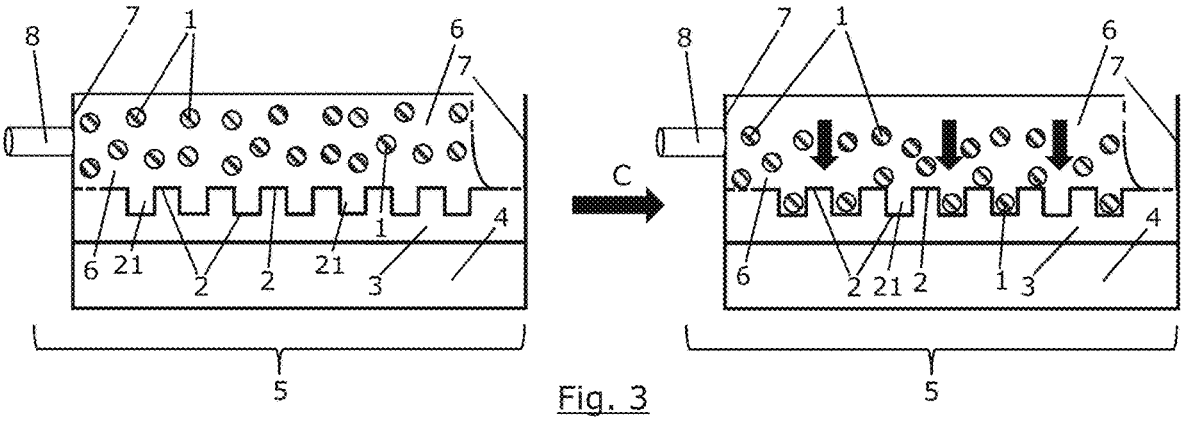

The sedimentation step C, illustrated in FIG. 3, of the particles 1 contained in the colloidal suspension 6 follows the condensation step B. This step is implemented at ambient temperature comprised between approximately 19° C. and 23° C. for a duration of approximately seven minutes for particles having a maximum Feret diameter comprised between 9 and 11 μm. This step can equally well be implemented within a temperature range comprised between 0 and 50° C., preferably between 10 and 40° C., more preferably between 15 and 30° C.

During the sedimentation step C, the particles 1 sediment in the direction of the surface 2 of the sample 3. Following the sedimentation step C, a major portion of the microstructures 21 comprise particles 1 having sedimented within the microstructures 21. During the sedimentation step, a major portion of the particles 1 freely enter into a microstructure 21 as far as a surface forming a base of the microstructure 21.

In practice, the entire condensation step B is carried out simultaneously with the sedimentation step C. In fact, the sedimentation of the particles 1 starts as soon as the colloidal suspension 6 is injected into the chamber 10 of the cell. The sedimentation step C is thus partly implemented concomitantly with the condensation step B over a sedimentation temperature range starting at 5° C. and increasing over time up to the ambient temperature comprised between 19 and 23° C.

The implementation duration of the sedimentation step C is a function of the height of the cell, the size and the type of the particles 1. For a given type and size of particles 1, the sedimentation rate is calculated based on equation 2. The selection of particles 1 must be such that the sedimentation rate of the sedimenting particles 1 is such that a significant portion of said sedimenting particles 1 is still contained in the colloidal suspension subsequently to the implementation of the covering step A.

Figure 4:
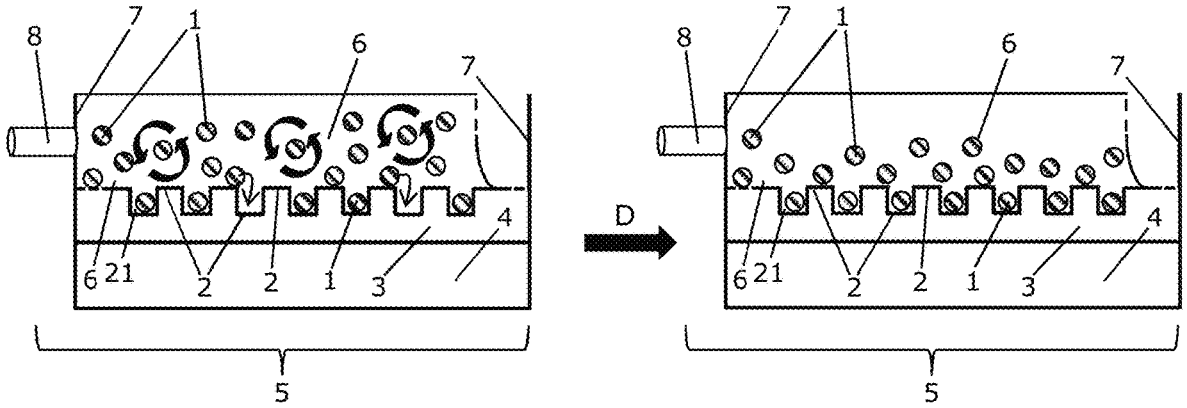

The sedimentation step C is followed by a convective trapping step D of the particles 1 in the microstructures 21, illustrated in FIG. 4, being implemented at a temperature of 50° C. for a duration of 5 mins. The effect of this step is to increase the convection phenomena so that the particles 1 resting on the surface 2 of the sample 3 in proximity to empty microstructures 21 are displaced above the empty microstructures 21 and sediment inside these empty microstructures 21. The trapping step D makes it possible to increase the fill rate of the microstructures 21 by the particles 1.

Depending on the embodiment, not all the particles 1 contained in the colloidal suspension 6, have sedimented when the trapping step D is initiated. Thus, according to the embodiment, at least a portion of the convective trapping step D is carried out concomitantly with the sedimentation step C. The entire convective trapping step D can be carried out concomitantly with the sedimentation step C.

The implementation duration of the convective trapping step D is a function of the initial concentration of particles 1 in the colloidal suspension 6 and the density of microstructures 21 on the surface 2 of the sample 3. The duration of the convective trapping step D to be applied can be determined experimentally.

Figure 5:
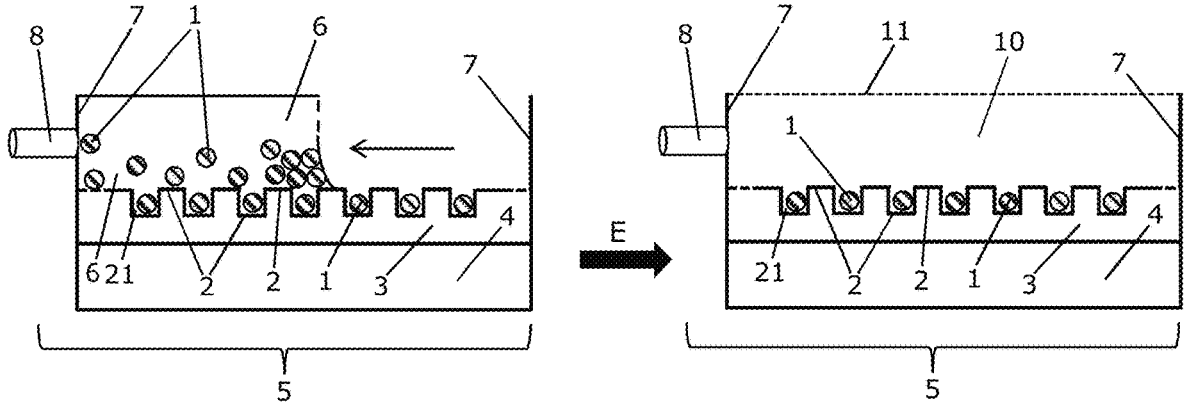

The removal step E, illustrated in FIG. 5, of the colloidal suspension from the surface 2 of the sample 3 is implemented following the convective trapping step D. The removal step E does not require a particular temperature to be imposed on the cell. Thus, the removal step E can, preferentially, be carried out at ambient temperature comprised between 19 and 23° C. Removing the colloidal suspension 6 from the chamber 10 is carried out by aspiration of the colloidal suspension 6 by the syringe (not shown) through the needle 13 (not shown) introduced into the capillary 8. The removal step E consists of laminar flow, induced by aspiration, of the colloidal suspension 6 over the surface 2 of the sample 3 according to a movement that is substantially tangential extending in a direction connecting the two walls 7. This tangential movement carried out at controlled speed makes it possible to remove the excess particles 1 which have sedimented on the surface 2 outside the microstructures 21 while not removing the particles 1 lodged in the microstructures 21.

The withdrawal flow rate is approximately 1 ml/min depending on the embodiment. The removal flow rate can vary between 10 μl/min and 10 ml/min as a function of the geometry of the cell. The removal flow rate is calculated so that the linear velocity of removal of the colloidal suspension 6 is of the order of 0.05 cm/min to 50 cm/min. Depending on the embodiment, the removal time of the colloidal suspension 6 is approximately one minute.

The removal flow rate is adjusted as a function (i) of the receding angle formed between the colloidal suspension 6 and the surface 2 and (ii) of the dynamic viscosity of the colloidal suspension 6. The removal step E directly influences the fill rate of the microstructures 21 by the particles 1. A removal that is too quick or carried out in fits and starts will lead to a significant fall in the fill rate of the microstructures 21.

Figure 6:
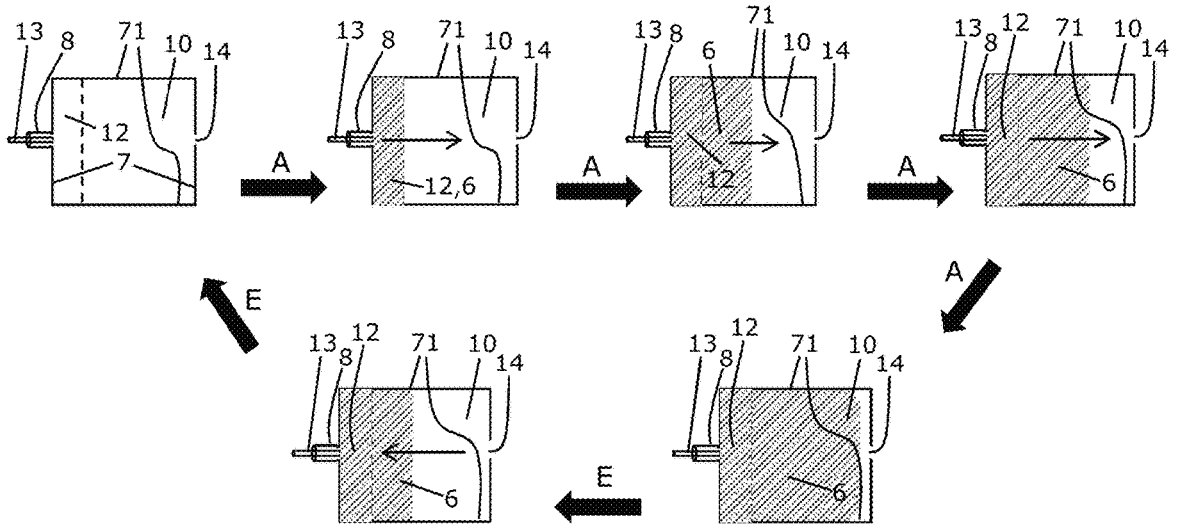
FIG. 6 is a diagrammatic representation of a top view of a microfluidic device, as described in document EP2942111A2, illustrating the filling and removal steps of the method according to the invention.

With reference to FIG. 6, the covering step A of the surface 2 of the sample 3 with the colloidal suspension 6 and the removal step E of the colloidal suspension 6 from the surface 2 of the sample 3 is described. As described in document EP2942111A2, the microfluidic cell comprises a pre-chamber 12 and a chamber 10. The chamber 10 is arranged to receive the colloidal suspension 6 and the microstructured surface 2 of the sample 3 constitutes one of the walls of the chamber 10. The chamber 10 is delimited by the walls 7, walls 71, the surface 2 of the sample 3 and the glass slide 11. The chamber 10 comprises the vent 14 and the capillary 8. The needle 13 of a syringe (not shown) is also shown inserted in the capillary 8. The pre-chamber 12 is contiguous and opens into the chamber 10. The colloidal suspension 6 is injected into the pre-chamber 12. The colloidal suspension 6 then progresses into the chamber 10 by wetting of the walls 71 (also wall 7 on the side of the syringe), the sample 3 and the glass slide 11, forming a front progressing in the direction of the wall 7 comprising the vent 14. Injecting the colloidal suspension 6 into the pre-chamber 12 is stopped so that the colloidal suspension 6 does not come into contact with the wall 7 comprising the vent 14. After implementing the convective trapping step D, the colloidal suspension 6 is aspirated into the syringe according to the removal step E described above.

Figure 7:
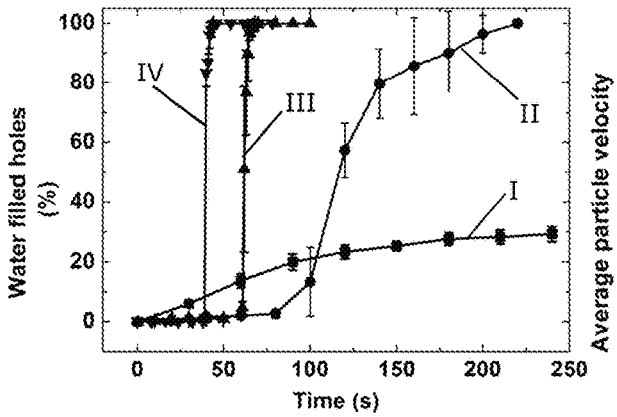
FIG. 7 is a graph illustrating the influence of the implementation temperature of the condensation step through the development of the number of microstructures that do not contain air bubbles during the implementation of the condensation step as a function of the implementation temperature of the condensation step.

With reference to FIG. 7, the development of the number of microstructures 21 no longer containing air bubbles 9 during implementation of the condensation step A is described. The y-axis of the graph in FIG. 7 shows the percentage of microstructures 21 not occupied by an air bubble 9 and the x-axis the time in seconds. The curve I illustrates the implementation of the condensation step A at a temperature of 25° C., the curve II at a temperature of 18° C., the curve III at a temperature of 12° C. and the curve IV at a temperature of 6° C. It is noted that for a temperature of 25° C., less than 30% of the microstructures 21 no longer contain air bubbles 9 after 250 seconds while for a temperature of 6° C., all of the microstructures 21 no longer contain air bubbles 9 after less than 50 seconds. The condensation step B can thus be carried out over a temperature range an upper limit of which is less than 25° C. Preferably, an upper limit of the condensation temperature range is less than the lower limit of the sedimentation temperature range. Preferably, an upper limit of the condensation temperature range is less than the lower limit of the sedimentation temperature range by at least 10 degrees Celsius (°). Preferably, a lower limit of the condensation temperature range is less than 20° C., preferably less than 15° C., even more preferably less than 10° C. The implementation temperature of the condensation step B is, preferably, adjusted in such a way that the implementation duration of the condensation step B is less than 10 mins, preferably than 5 mins.

Figure 8:
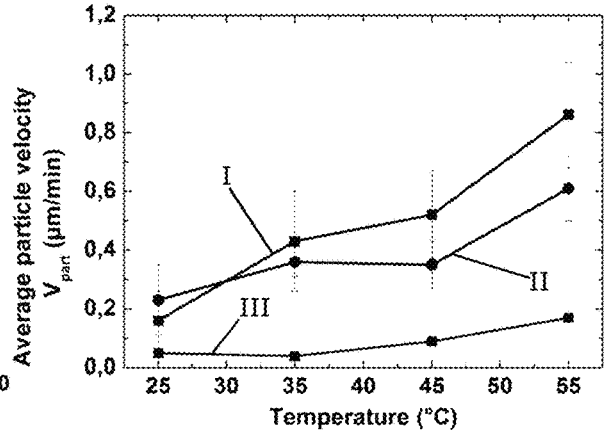
FIG. 8 is a graph illustrating the influence of the implementation temperature of the trapping step through the development of the average velocity of the particles contained in the colloidal suspension as a function of the implementation temperature of the trapping step.

With reference to FIG. 8, the development of the average velocity of particles 1 of PS of a size of 10 μm on the curve I, PS of a size of 5 μm on the curve II and $SiO_2$ of a size of 8 μm on the curve III, as a function of the temperature of the Pelletier device 4. The y-axis represents the average velocity of the particles 1 in micrometres per minute and the x-axis the temperature in degrees Celsius. Taking account of the volume of colloidal suspension 6 contained in the microfluidic cell and the volume densities of the different types of particles 1 used, the temperature of the particles 1 is considered to be almost instantaneously equal to the temperature of the colloidal suspension 6, itself considered to be almost instantaneously equal to that of the Pelletier module 4. An increase in the temperature of the colloidal suspension 6 makes it possible to increase the speed of the particles 1. It is noted that for temperatures less than 30° C., the diameter of the particles 1 has little influence on the average velocity of the particles 1. In addition, for equivalent diameters, the particles 1 of different materials have equivalent average velocities. On the other hand, for temperatures greater than 30° C. and for one and the same type of particle 1, the greater the diameter of the particles 1, the greater the average velocity of the particles 1. Thus, an increase in the temperature makes it possible to reduce the time necessary for a particle 1, having sedimented on the surface 2 of the sample 3 in proximity to an empty microstructure 21, to be displaced over the surface 2 of the sample 3 until it is located directly above said empty microstructure 21 and to enter therein under the effect of gravitation. In this way, the convective trapping step D makes it possible to increase the fill rate of the microstructures 21 by the particles 1 by increasing the convection flow of the particles 21. The trapping step D can thus be carried out within a temperature range a lower limit of which is greater than 25° C. Preferably, a lower limit of the trapping temperature range is greater than an upper limit of the covering temperature range. Preferably, a lower limit of the trapping temperature range is greater than an upper limit of the sedimentation temperature range. Preferably, a lower limit of the trapping temperature range is greater than an upper limit of the covering temperature range by at least 10° C. Preferably, a lower limit of the trapping temperature range is greater than an upper limit of the sedimentation temperature range by at least 10° C. Preferably, the lower limit of the trapping temperature range is greater than 25° C., preferably greater than 30° C., more preferably greater than 40° C. The implementation temperature of the trapping step D will be adjusted in such a way that the implementation duration of the trapping step D is less than 10 mins.

Figure 9:
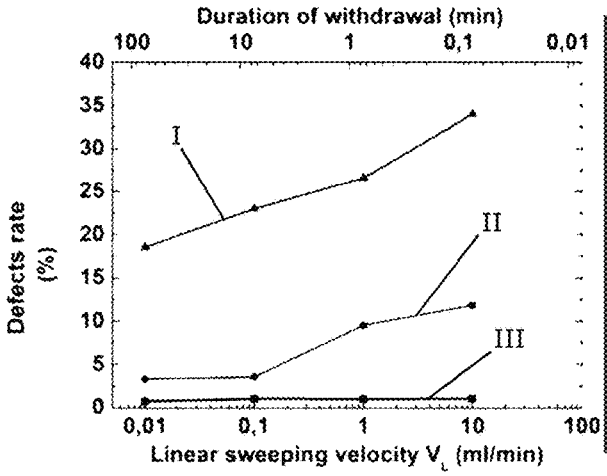
FIG. 9 is a graph illustrating the effects of the linear velocity of removal of the colloidal suspension and the number of particles contained in the colloidal suspension on the defects rate of the assembly obtained.

With reference to FIG. 9, the development of the fill rate of the microstructures 21 is illustrated as a function of the linear velocity of removal of the colloidal suspension 6 from the surface 2 of the sample 3 and the number of particles 1 contained in the colloidal suspension 6. The y-axis represents the defects rate as a percentage, i.e. the number of microstructures 21 that are not occupied by a particle 1 after implementation of the method. The upper x-axis represents the total duration of removal of the colloidal suspension 6 in minutes and the lower x-axis represents the linear sweeping velocity of the colloidal suspension 6 applied during the removal step E in millilitres per minute. The curve I corresponds to a number of particles 1 contained in the colloidal suspension 6 such that the ratio between the number of particles 1 and the number of microstructures 21 is comprised between 0.5 and 1, the curve II such that the ratio between the number of particles 1 and the number of microstructures 21 is comprised between 1 and 2, and the curve III such that the ratio between the number of particles 1 and the number of microstructures 21 is comprised between 2.5 and 5. The colloidal suspensions 6, of which the number of particles 1 they contain is equal to or less than the number of microstructures 21, have a high percentage of defects, being equal to 34% for the high removal velocities (10 ml/min) and 18% for the low removal velocities (0.01 ml/min). The colloidal suspensions 6, of which the number of particles 1 they contain is equal to or double the number of microstructures 21, have a moderate percentage of defects, being equal to 12% for the high removal velocities (10 ml/min) and 3% for the low removal velocities (0.01 ml/min). The colloidal suspensions 6, of which the number of particles 1 they contain is equal to at least two and a half times the number of microstructures 21, the defect number is of the order of 1% regardless of the removal velocity of the colloidal suspension 6.

Figure 10:
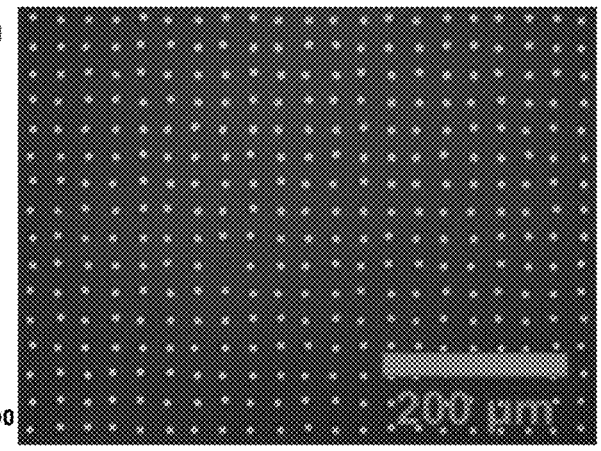
FIG. 10 is a fluorescence microscopy image of the assembly obtained from fluorescent polystyrene particles assembled on a substrate of polydimethylsiloxane.

With reference to FIG. 10, the result of the implementation of the method according to the embodiment applied to fluorescent PS particles 1 of 10 μm is illustrated. The fluorescence microscopy image presented in FIG. 10 illustrates the efficiency of the method according to the invention. The PS particles 1 can be seen inside the microstructures 21. The assembly obtained has a very low defects rate. The assembly is obtained in less than 30 minutes. The method is suitable for large sample surface areas 3, such as of the order of square centimetres or square metres. The total implementation time can be further reduced, according to requirements, for example by increasing the number of particles 1 contained in the colloidal suspension 6.

Of course, the invention is not limited to the examples which have just been described and numerous adjustments can be made to these examples without exceeding the scope of the invention.

Thus, in variants of the embodiments described above that can be combined together:

- a depth of a microstructure 21 is arranged to accommodate several stacked particles 1, and/or
- a microstructure 21 is arranged to receive several particles 1, and/or
- a microstructure 21 has any shape whatsoever, and/or
- the chamber 10 does not comprise a capillary 8, in this case, the needle 13 is inserted through the wall 7 as far as the inside of the chamber 10, and/or
- the covering step A of the surface 2 of the microstructured sample 3 with the colloidal suspension 6 can be carried out by introducing the colloidal suspension 6 into the chamber 10 and be devoid of the flow of the colloidal suspension 6 into the chamber 10, and/or
- during the sedimentation step C, at least a portion of the sedimenting particles 1 only partially enter the microstructures 21, and/or
- the condensation step B is carried out only partially simultaneously with the sedimentation step C, and/or
- a part of the condensation step B can be carried out concomitantly with a portion of the sedimentation step C, and/or
- the dispersing phase of the colloidal suspension 6 contains a mixture of one or more organic solvents with water, and/or
- the dispersing phase of the colloidal suspension 6 contains a mixture of one or more organic solvents and an absence of water, and/or
- a quantity of water contained in the dispersing phase of the colloidal suspension 6 is greater than one part per million (ppm), and/or
- the bubbles 9 trapped inside the microstructures 21 during the covering step A are not necessarily air bubbles but are more generally gas bubbles, and/or
- the bubbles 9 trapped inside the microstructures 21 during the covering step A are bubbles constituted by the gas which surrounds the sample during the implementation of the covering step, and/or
- the sedimentation step C, carried out based on a colloidal suspension 6 under a sedimentation regime, can be substituted by a colloidal suspension 6 under a Brownian ballistic regime, in this case:
  - said sedimentation step C comprises a step of modifying the composition of the colloidal suspension 6 covering the microstructured surface 2 of the sample 3, so that, after this modification step, the particles 1 contained in the colloidal suspension 6 sediment, and/or
  - a maximum value of a maximum Feret diameter of each particle 1 contained in the colloidal suspension 6 is such that:

$$D_{fm} \leq 2.5\ 10^{-3}\left(\frac{k_B T \mu^2}{\pi \rho \Delta_\rho^2 g^2}\right)^{\frac{1}{7}},$$

and/or the step of modifying the composition of the colloidal suspension 6 is carried out in such a way as to produce a flocculation of at least a portion of the particles 1 contained in the colloidal suspension 6, and/or the step of modifying the colloidal suspension composition 6 comprises an addition of a flocculation agent in the colloidal suspension 6, and/or the flocculating agent is an inorganic salt or a polymer, and/or the inorganic salt is selected from the family of the metal salts, it can for example be an iron or aluminium salt, and/or the flocculating agent is selected from the polymeric flocculants, the polymeric flocculant is selected, for example, from the family of the polyacrylamides, and/or the flocculation step starts the sedimentation of the particles 1.

In addition, the various characteristics, forms, variants and embodiments of the invention can be combined together in various combinations, inasmuch as they are not incompatible or mutually exclusive.

The invention claimed is:

1. A method for assembling particles on a microstructured surface of a sample, said method comprising:

a step of covering the surface of the sample with a colloidal suspension, the covering step being carried out within a temperature range called covering temperature range;

a step of sedimentation of particles contained in the colloidal suspension so that particles sediment in the direction of the surface of the sample and at least a portion of the sedimenting particles enter at least partially into the microstructured surface, the sedimentation step being carried out within a temperature range called sedimentation temperature range; and a condensation step of expelling the air bubbles from the microstructures by dissolving the bubbles in water and condensing the aerated water from the air bubbles, the condensation step is implemented prior to and/or, at least partially, simultaneously with the sedimentation step, a lower limit of the sedimentation temperature range is greater than an upper limit of a condensation temperature range.

2. The method according to claim 1, wherein said condensation step is implemented:

subsequently to the covering step; and prior to and/or concomitantly with the sedimentation step, the condensation step being carried out within a temperature range called condensation temperature range, an upper limit of the condensation temperature range being less than a lower limit of the covering temperature range.

3. The method according to claim 2, in which the condensation step is implemented prior to the sedimentation step and in which a lower limit of the sedimentation temperature range is greater than an upper limit of the condensation temperature range.

4. The method according to claim 2, in which the lower limit of the condensation temperature range is less than 20° C.

5. The method according to claim 1, comprising a step of trapping particles in the microstructures of the sample, the trapping step being carried out:

concomitantly with or subsequently to the sedimentation step, and within a temperature range called trapping temperature range.

6. The method according to claim 5, in which a lower limit of the trapping temperature range being greater than an upper limit of the covering temperature range.

7. The method according to claim 5, in which the trapping step is implemented subsequently to the sedimentation step and in which a lower limit of the trapping temperature range is greater than an upper limit of the sedimentation temperature range.

8. The method according to claim 5, in which the lower limit of the trapping temperature range is greater than 25° C.

9. The method according to claim 1, comprising a step of removing the colloidal suspension from the microstructured surface of the sample, according to a movement that is substantially tangential with respect to said microstructured surface, so as to remove an excess of particles present on the surface of the sample, the removal step being implemented subsequently to the sedimentation step and/or the trapping step.

10. The method according to claim 9, in which, during the step of removing the colloidal suspension, a receding contact angle formed between the colloidal suspension and the microstructured surface of the sample is comprised between 10° and 80°.

11. The method according to claim 9, in which a linear velocity of removal of the colloidal suspension is comprised between 0.05 and 50 cm/min.

12. The method according to claim 1, in which the covering step is carried out using a suspension a dispersing phase of which comprises:

at least partly water.

13. The method according to claim 12, in which the covering step is carried out using a suspension the dispersing phase of which comprises a mixture of solvents.

14. The method according to claim 1, in which the sedimentation step is carried out using a colloidal suspension under a sedimentation regime, the effects of gravitation on at least a portion of the particles contained in the colloidal suspension being greater than the thermal agitation effects on said at least a portion of the particles contained in the colloidal suspension.

15. The method according to claim 1, in which a size distribution of the particles contained in the colloidal suspension is such that a maximum Feret diameter $D_{fm}$ of each particle contained in the colloidal suspension is such that:

$$D_{fm} \geq 2.5\ 10^{-3}\left(\frac{k_B T \mu^2}{\pi \rho \Delta_\rho^2 g^2}\right)^{1/7},$$

with $k_B$: the Boltzmann constant,

T: a temperature of the particles contained in the suspension corresponding to the lower limit of the sedimentation temperature range, μ: dynamic viscosity of the dispersing phase at the temperature T, Δρ: difference between a mass density of the particles contained in the colloidal suspension and a mass density of the dispersing phase, ρ: mass density of the dispersed phase at the temperature T, and g: the gravitational constant.

16. The method according to claim 1, in which a size distribution of the particles contained in the colloidal suspension can be such that:

a maximum Feret diameter $D_{fm}$ of each particle contained in the colloidal suspension is greater than 100 nm, and/or a maximum Feret diameter $D_{fm}$ of each particle contained in the colloidal suspension is less than 100 μm.

17. The method according to claim 1, in which at least a portion of the steps are implemented in a microfluidic device comprising, a chamber arranged to receive the colloidal suspension, one of the walls of which comprises, at least partially, the microstructured surface of the sample.

18. The method according to claim 1, in which the step of covering the surface of the microstructured sample with the colloidal suspension is carried out by introducing the colloidal suspension into the chamber and by flow, by capillary effect, of the colloidal suspension into the chamber.

19. The method according to claim 1, in which the covering temperature range is comprised between 0 and 50° C.

20. The method according to claim 1, in which the sedimentation temperature range is comprised between 0 and 50° C.

* * * * *